US006494424B1

(12) United States Patent
Dickie et al.

(10) Patent No.: US 6,494,424 B1
(45) Date of Patent: Dec. 17, 2002

(54) STRUCTURE FOR REMOVABLY SECURING A CONTAINER TO A SUBSTANTIALLY PLANAR SUPPORTING SURFACE

(76) Inventors: Robert G. Dickie, 15 Valley Trail, Newmarket, Ontario (CA), L3Y 4V8; Kirk Tierney, R. R. #1, Schomberg, Ontario (CA), L0G 1T0

( * ) Notice: Subject to any disclaimer, the term of this patent is extended or adjusted under 35 U.S.C. 154(b) by 145 days.

(21) Appl. No.: 09/625,174

(22) Filed: Jul. 25, 2000

(51) Int. Cl.[7] ..... A47G 1/17
(52) U.S. Cl. ..... 248/205.3; 248/467; 248/683
(58) Field of Search ..... 248/205.3, 467, 248/683; 206/469, 63.5; 132/321

(56) References Cited

U.S. PATENT DOCUMENTS 3,667,596 A * 6/1972 Lucas et al. ..... 248/205.3
4,706,914 A * 11/1987 Ground ..... 248/74.3
5,507,464 A * 4/1996 Hamerski et al. ..... 248/683
5,984,247 A * 11/1999 Luhmann et al. ..... 248/205.3
5,989,708 A 11/1999 Kreckel
6,001,471 A 12/1999 Bries et al.
6,004,642 A * 12/1999 Langford ..... 248/467
6,193,201 B1 * 2/2001 Babcock ..... 248/311.2
6,295,996 B1 * 10/2001 Dickie ..... 132/321
6,295,997 B1 * 10/2001 Dickie ..... 132/321
6,364,113 B1 * 4/2002 Faasse, Jr. et al. ..... 206/469

* cited by examiner

*Primary Examiner*—Anita King
*Assistant Examiner*—Tan Le

(57) ABSTRACT

A structure for removably securing a container to a planar supporting surface comprises a flexible plastic tape having an adhesive coating on a first portion of each of its two sides, and a second portion where there is no adhesive coating. The second portion forms a graspable tab to facilitate removal of the container from its supporting surface, and is retained in a position which is generally out of sight. De-adherence of the flexible plastic tape is achieved by stretching the tape from the graspable tab. Retaining means for the graspable tab may comprise a slot which is parallel to the back face of the container, located a distance away from the back face which is less than the length of the graspable tab; or it may also comprise a pair of opposed tabs spaced away from and substantially parallel to the face against which the graspable tab is placed.

5 Claims, 3 Drawing Sheets

STRUCTURE FOR REMOVABLY SECURING A CONTAINER TO A SUBSTANTIALLY PLANAR SUPPORTING SURFACE

FIELD OF THE INVENTION

The present invention relates to structures for removably securing a container to a substantially planar supporting surface. In particular, the present invention relates to structures which permit the placement and removal of a container, or other item having width, depth, and thickness, to a supporting surface in such a manner that the structure is retained in a position which is out of sight until such time as the container or other item having width, depth, and thickness, is to be removed from its supporting surface.

BACKGROUND OF THE INVENTION

People have always wanted to mount objects to supporting surfaces. Typically, such mounting of objects to supporting surfaces is, for example, hanging paintings on walls, placing calendars or posters or the like on a wall, putting clocks and decorative items in place, and so on. Sometimes this is accomplished by driving nails or screws into the wall, or by the use of adhesive tape, and so on. Indeed, there is a myriad of different ways of hanging or securing items in place on a supporting surface.

However, there are some supporting surfaces which, for a variety of reasons, do not invite or permit items to be secured to them. Mirrors and glass windows are such an example, as well as relatively thin structures such as medicine cabinet doors and the like where it is impossible to place a nail or screw due to the lack of material to grasp the nail or screw to hold it in place. Of course, except carefully and very skilfully, it is not possible to place a nail or screw through a glass structure such as a mirror or window.

Other means for securing items in place include adhesive and gummed tapes, hanging devices, and so on.

None of these devices, however, is deemed to be satisfactory in many instances, particularly instances where the item to be secured to a supporting surface is to be removably secured so it can be taken away at a later time.

For example, if nails or screws are used to secure any item to a wall, and the nail or screw is later removed, an unsightly hole may be left. Likewise, if a gummed or adhesive hanger is to be used, and later removed, it may take the paint with it.

Of course on glass or mirrors, and the like, the use of gummed or adhesive tapes may result in the gum or adhesive being left on the surface after the securing tape has been removed. Such circumstance is unsightly, and may require further treatment so as to remove the residue.

Several products have been introduced to the market, particularly by 3-M Company in association with the trademark COMMAND™. The items which are being marketed are, in particular, plastic strips which are intended for placing posters on the wall, or hooks which may be removably secured to a wall, without damage to the wall in any event. However, when these adhesive strips or devices having adhesive strips are used, there always remains a removal tab which is grasped to stretch the tape and thereby de-laminate it from the supporting surface against which it has been placed. The adhesive strip may or may not be removable from the item to which it has been attached.

In any event, the removal tab which forms an integral part of the adhesive strips is unsightly. It is possible to secure a poster to a wall in such a manner that the adhesive strips are totally covered, but in that case there may be a tendency for the bottom edge of the poster to curl.

There may also be circumstances where it is desirable to place a container or other device which has width, depth, and thickness, in a manner such that it is removably secured to a substantially planar supporting surface. Such circumstances may, indeed, include the mounting of framed pictures, holders for writing or cooking utensils, magnifying mirrors for use when applying makeup or inserting or removing contact lenses, placing decorative items on windows or mirrors, or placing such items as dental floss dispensers on bathroom mirrors or on the back surface of a medicine cabinet door. In all of those instances, the item to be removably secured to a substantially planar supporting surface exhibits the characteristics of having width, depth, and thickness, and may be a container or other item as suggested above. In any event, the use of adhesive strips having the necessary characteristic that they permit removable securement to a substantially planar supporting surface, especially without damage to the supporting surface or without leaving a residue, is to be commended; but until now use of such adhesive strips may not necessarily be acceptable, due to the presence of an unsightly removal tab.

On the other hand, it is generally desirable that at least a small portion of the removal tab should be either visible or at least very easily accessible, so that when it is desired to remove the container or other item by de-adhering the plastic adhesive strip from the supporting surface, the removal tab and its intended purpose will be available and understandable to the user.

Until now, any advertising that is currently known in publications and is particularly on television which promotes the stretchable and removable adhesive plastic strips, has clearly indicated the evident and unsightly presence of the removal tab.

SUMMARY OF THE INVENTION

The present invention provides a structure for removal of a container or other item from a substantially planar supporting surface, in such a manner that the graspable removal tab is folded forwardly and generally out of sight from the substantially planar supporting surface to which the container or other item has been removably secured, by providing a means for retaining the graspable removal tab in a folded and generally out of sight condition which extends forwardly from a substantially planar back face of the container or item being removably secured to the substantially planar supporting surface.

An object of the present invention, therefore, is to provide for such a structure as described immediately above, whereby the structure can be employed to secure a container or item to a substantially planar supporting surface by employing a flexible plastic tape, but retaining a graspable removal tab in a generally out of sight condition after the container or other item has been mounted in place.

To that end, therefore, the present invention provides a structure for removably securing a container or other item having width, depth, and thickness, to a substantially planar supporting surface in such a manner that a portion of the structure is retained in a position which is generally out of sight but from which that portion may be put into an operable position. Thus, the container or other item to be removably secured to a substantially planar supporting surface has a substantially planar back face which is to be placed adjacent a substantially planar supporting surface, and it has at least one substantially planar container thickness defining face which extends forwardly from the substantially planar back face.

The structure comprises a flexible plastic tape having an adhesive coating on at least a first portion of each of the first and second sides thereof, and having a second portion at a first end of each of the first and second sides where there is no adhesive coating adhered thereto.

The first side of the flexible plastic tape is adhered to the substantially planar back face of the container at the first portion of the tape. The second portion of the flexible plastic tape forms a graspable tab to facilitate removal of the container or other item from a planar supporting surface when it has been adhered thereto by the adhesive coating on the second side of the tape. De-adherence of the flexible plastic tape at least from the planar supporting surface is achieved by stretching the tape by grasping the graspable tab.

The structure in keeping with the present invention further comprises retaining means for the graspable tab.

The retaining means is located on the at least one substantially planar container thickness defining face, for releasably retaining the graspable tab in a folded and a generally out of sight condition extending forwardly from the substantially planar back face of the container or the other item.

For the sake of clarity, and so as to avoid ambiguity, use of the word "container" herein is intended to relate to any item which has the characteristics of width, depth, and thickness, with at least a substantially planar back face and at least one substantially planar container thickness defining face which extends forwardly from the substantially back face.

In a particular embodiment of the present invention, the retaining means comprises a slot which is formed in the at least one substantially planar container thickness defining face for inserting the first end of the flexible plastic tape thereinto. The slot is parallel to the substantially planar back face of the container, and is located a distance away from the substantially planar back face of the container, which distance is less than the length of the graspable tab.

In another embodiment of the present invention, the retaining means comprises a pair of opposed tabs which are spaced away from and substantially parallel to that portion of the at least one substantially planar container thickness defining face against which the graspable tab is placed when it is folded forwardly from the substantially planar back face of the container. The distance between the opposed tabs is less than width of the flexible plastic tab. The first end of the plastic tab extends forwardly of the pair of opposed tabs.

In a structure as defined immediately above, the portion of the at least one substantially planar container thickness defining face against which the graspable tab is placed, is formed as a shelf or groove which has a width greater than the width of the flexible plastic tab.

DESCRIPTION OF THE PRIOR ART

Two representative prior art patents, each teaching flexible plastic tapes of the sort discussed above, and each belonging to 3-M Innovative Properties Company of St. Paul Minn., are noted below;

First there is U.S. Pat. No. 5,989,708 to Kreckel, issued Nov. 23, 1999. That patent teaches a removable adhesive tape which has a highly extensible and substantially elastic backing, and a layer of pressure sensitive adhesive. The backing has a high tensile strength and may be elongated or stretched by at least about 150 percent, with less than 50 percent of elastic recovery after being stretched. The adhesive is a normally tacky and pressure-sensitive adhesive, which is coated on at least one surface of the film backing. The adhesive is preferable highly extensible, and will not separate from the backing during stretching; and the adhesive has higher cohesion than adhesion to any suitable substrate. After it is applied to a substrate, the adhesive tape is firmly bonded to that substrate, but can be easily be removed without damaging the substrate by stretching the adhesive tape in the direction which is substantially parallel, and in any event not more than about 35 degrees to the surface of the substrate to which it has been applied.

The other patent is issued to Breis et al as U.S. Pat. No. 6,001,471, dated Dec. 14, 1999. A double-sided removable and stretchable adhesive tape is described, and is said to be for use in conventional applications including particularly the mounting or joining of an object to another surface. In this case, the timing of the debonding of both surfaces is controlled so that one adhesive surface releases before the other. This is achieved by use of a double-sided adhesive tape which has a stretchable backing layer, which is plastic or elastic, and which has a lower adhesion or non-adhesive portion of one adhesive surface, so that a corresponding greater adhesion adhesive portion on the other side of the tape remains more aggressively adhered to a surface during stretch removal. The portion of the one adhesive surface which is less adhesively adhered may then be completely released from the surface. There may be a non-adhesive portion which provides the removal tab and which, in all Figures of the drawings is shown to extend downwardly from an object being adhered to a surface, in a direction parallel to the surface to which the object is adhered.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

It has been noted that the present invention finds usefulness in any instance where a container or other item which has width, depth, and thickness, is to be removably secured to a substantially planar supporting surface and where the container or other item itself has a substantially planar back surface. It has also been noted that use of the word "container" is intended to identify any item which has the characteristics of width, depth, and thickness, and to which a structure for removably securing that item to a substantially planar supporting surface is applicable.

In the discussion which follows, which is taken in association with the accompanying drawings, the representative containers which are shown in the Figures happen to be dental floss dispensers of the sort which are described in issued U.S. Pat. Nos. 6,295,996 and 6,295,997, filed of even date herewith, each in the name of Robert G. Dickie. Two different embodiments of containers are illustrated in the accompanying drawings, in FIGS. 1 to 7 and FIGS. 8 to 13, respectively; but as the specific details of those containers are not relevant to the present invention, none are given except as may be necessary to provide a full and appropriate teaching of the present invention.

The structure which is disclosed herein in its several embodiments is one which is used in association with a container or other item. Essentially, the structure comprises a flexible plastic tape having particular characteristics as are described in greater detail hereafter, and a retaining means which is located on the container or other item as noted. It is only necessary that the container or other item in association with which the structure of the present invention is used, and in respect of which the retaining means for the graspable tab of the flexible plastic tape is found, shall have the characteristics of width, depth, and thickness, a substantially planar back face, and at least one substantially planar container thickness defining face which extends forwardly from the substantially planar back face.

Figure 1:
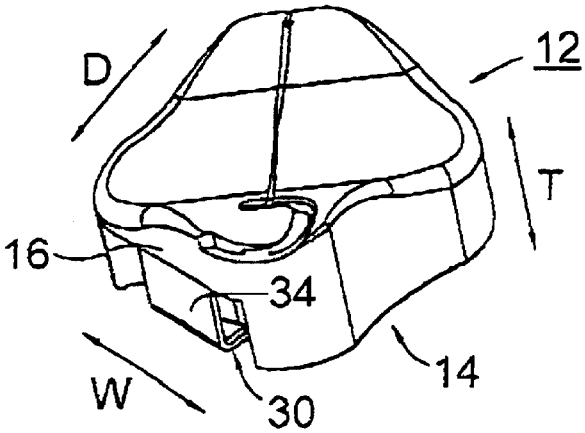
FIG. 1 is a perspective view, from the top front, of a typical container which incorporates a structure for removably securing that container to a substantially planar supporting surface.
Figure 2:
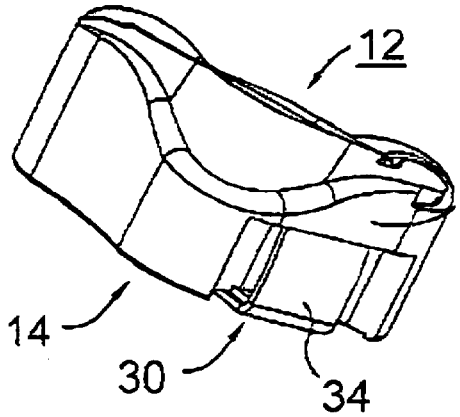
FIG. 2 is a perspective view of the same container of FIG. 1, seen from the side.
Figure 3:
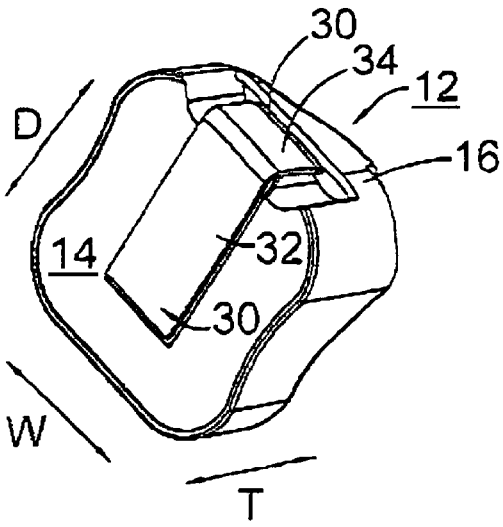
FIG. 3 is a perspective view of the same container as FIG. 1, seen from the back.

Turning first to FIG. 1 to 3, a typical container 12 is illustrated. That container has width, depth, and thickness, as illustrated by arrows W, D, and T, respectively. As noted above, it is a purpose of the present invention to provide a structure which will permit removable securement of the container 12 to a substantially planar supporting surface, not shown. That removable securement of the container 12 to the substantially planar supporting surface is in such a manner that a portion of the structure—as will be seen hereafter, the graspable tab—is retained in a position which is generally out of sight, but from which that portion may be put into an operable position.

The container 12 has a substantially planar back face 14 which is to be placed adjacent the substantially planar supporting surface, when the container is removably secured thereto. The container also has at least one substantially planar container thickness defining face 16, and that face 16 extends forwardly (or upwardly) from the substantially planar back face 14.

Referring briefly to FIGS. 8 to 13, a container 22 is shown; and since it has the same general characteristics of width, depth, and thickness, a substantially planar back face, and a substantially planar container thickness defining face extending forwardly from the substantially planar back face, the same reference arrows and reference numerals are used in FIGS. 8 to 13 as are used in FIGS. 1 to 7, to describe the same or essentially identical feature.

A major component of the structure for removably securing a container to a substantially planar supporting surface is a flexible plastic tape. That flexible plastic tape is shown generally at 30, throughout the Figures of drawings. The flexible plastic tape 30 has an adhesive coating on at least a first portion of each of the first and second sides thereof, and has a second portion at a first end of each of the first and second sides thereof, where there is no adhesive coating adhered thereto. That first portion is indicated at 32, and it is that portion of the first side of the flexible plastic tape which is adhered to the substantially planar back face 14 of the containers 12 or 22; and it is that portion of the second side of the flexible plastic tape which will be adhered as well to the substantially planar supporting surface when the containers 12 or 22 are removably secured thereto.

Generally, the outer surface of the portion 32 of the flexible plastic tape 30 is covered by a release cover (not shown) until such time as the container 12 or 22 is to be removably secured to a substantially planar supporting surface.

The second portion is indicated at 34, and it forms a graspable tab so as to facilitate removal of the container 12 or 22 from a planar supporting surface when it is adhered to it by the adhesive coating on the second side of the tape, at the portion 32.

As discussed, de-adherence of the flexible plastic tape 30 at least from the planar supporting surface is achieved by stretching the tape, by grasping the graspable tab 34.

It will be evident from even a cursory review of the drawings that there is a retaining means which is the other functional feature of the structure of the present invention, and that the retaining means has its purpose to retain the graspable tab 34 in a position which is generally out of sight, on or against the at least one substantially planar container thickness defining face 16. The graspable tap 34 is folded in a direction extending forwardly from the substantially planar back face 14, when it is held in place by the retaining means, which are described in detail hereafter.

The retaining means shown in FIGS. 1 through 7 differs from the retaining means shown in FIGS. 8 through 13.

Figure 4:
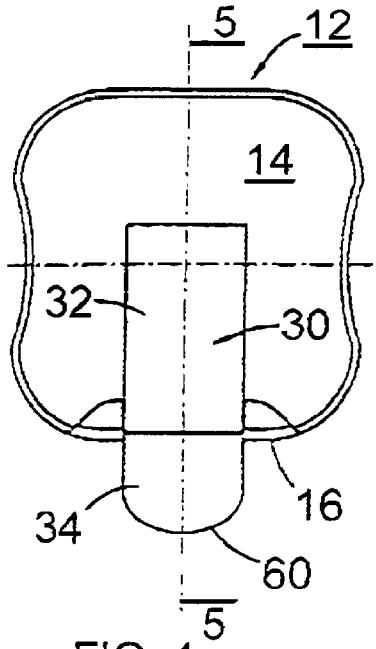
FIG. 4 is a plan view of the back face of the container of FIG. 1, with the graspable tab being shown in a first position.
Figure 5:
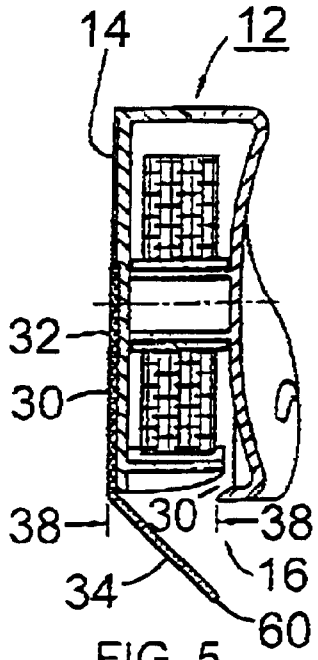
FIG. 5 is a sectional view, taken in the direction of arrows 5—5 in FIG. 4.
Figure 6:
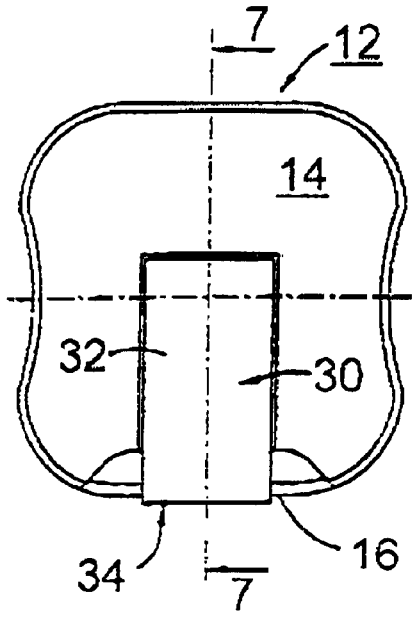
FIG. 6 is a view similar to FIG. 4, but showing the graspable tab in a folded condition.
Figure 7:
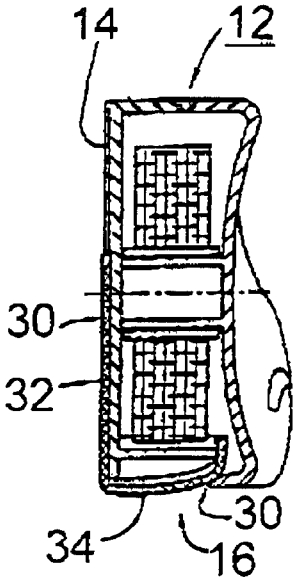
FIG. 7 is a view similar to FIG. 5 but taken in the direction of arrows 7—7 in FIG. 6.

Specifically, the retaining means shown in FIGS. 1 through 7 comprises a slot 30, which is best seen in FIGS. 3, 5, and 7. The slot 30 is formed in the container thickness defining face 16; and it is evident particularly from an examination of FIGS. 5 and 7 that the purpose of the slot 30 is for inserting the first end 60 of the flexible plastic tape 30 where the second portion and graspable tab 34 is formed, into the slot 30. In this manner, as can be clearly seen in each of FIGS. 1, 2, 3, 6, and 7, when the first end 60 of the flexible plastic tape is inserted into the slot 30, the graspable tab 34 is in a folded and generally out of sight condition and extends forwardly from the substantially back face 14 of the container 12.

Obviously, FIGS. 4 and 5 illustrate the graspable tab 34 in an intermediate position, either before the end 60 is inserted into the slot 30, or after it has been remove therefrom.

The slot 30 is, as indicated, parallel to the substantially planar back face 14 of the container 12, and it is located a distance away from the back face 14, which distance is indicated by the spaced arrows 38, 38 in FIG. 5. Clearly, from an examination of FIGS. 5 and 7, the distance 38, 38 is less than the length of the graspable tab 34.

Referring now to FIGS. 8 through 13, another embodiment of retaining means for the graspable tab 34 is shown. Here, the retaining means comprises a pair of opposed tabs 40.

Figure 8:
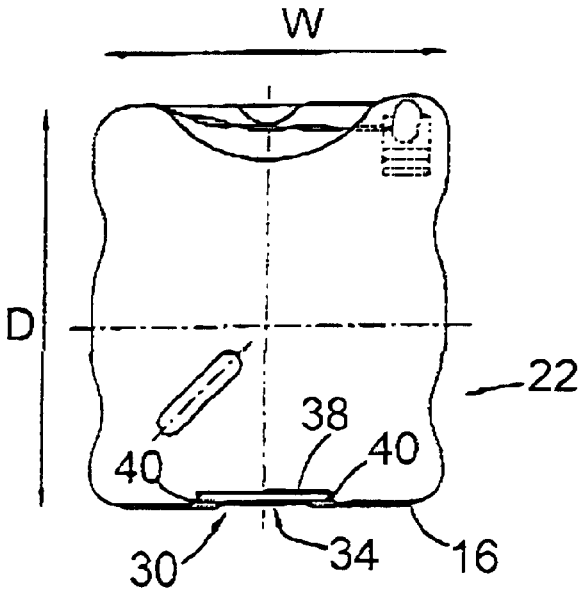
FIG. 8 is a front view of another container having another form of structure for removably securing that container to a substantially planar supporting surface, in keeping with the present invention.
Figure 11:
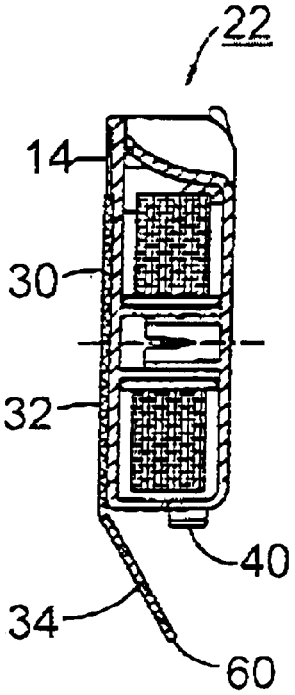
FIG. 11 is a sectional view looking in the direction of arrows 11—11 in FIG. 10.
Figure 13:
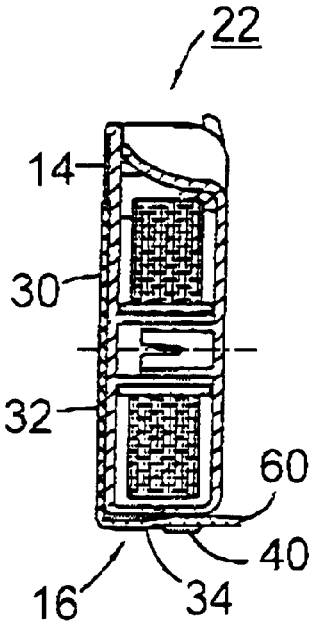
FIG. 13 is a sectional view taken in the direction of arrows 13—13 in FIG. 12.
Figure 12:
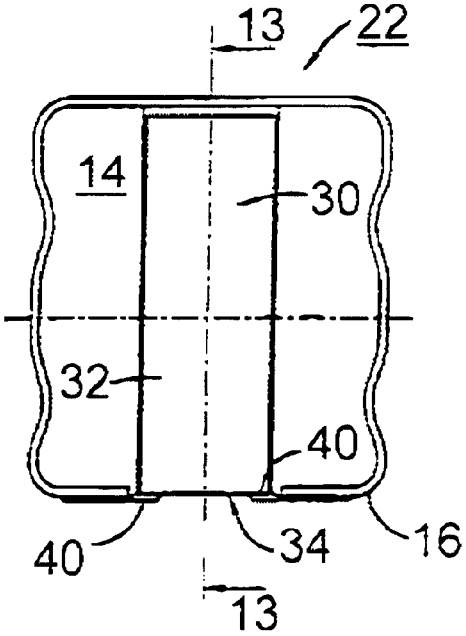
FIG. 12 is a view similar to FIG. 6, but of the container from FIG. 8, showing the second embodiment of the structure of the present invention.

As can be seen particularly in FIGS. 11 and 13, as well as in FIGS. 8 and 12, the pair of opposed tabs 40 are spaced away from and substantially parallel to that portion of the substantially planar container thickness defining face 16 against which the graspable tab 34 is placed, when it is folded forwardly from the substantially planar back face 14. Thus, the graspable tab 34 may be accommodated between the pair of opposed tabs 40.

Figure 9:
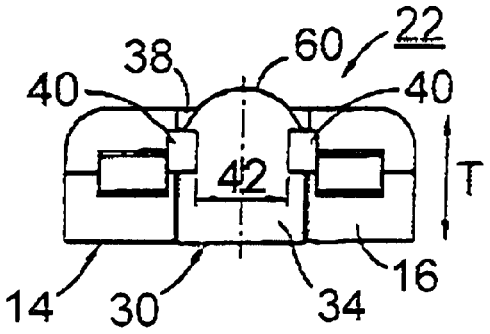
FIG. 9 is a bottom view of the container of FIG. 8.
Figure 10:
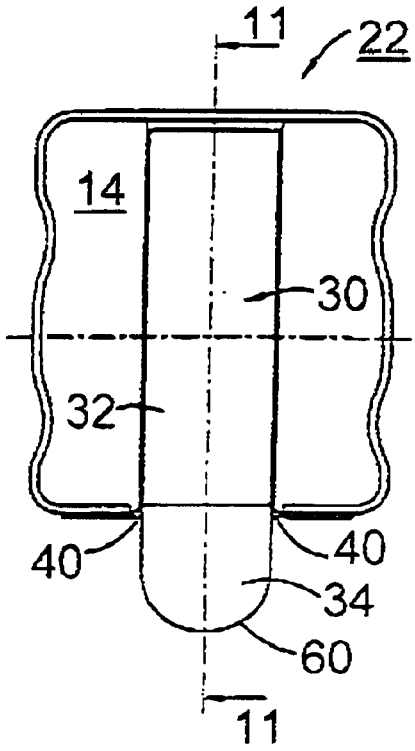
FIG. 10 is a view similar to FIG. 4, but of the container from FIG. 8, showing the second embodiment of the structure of the present invention.

The distance between the innermost edges of the pair of opposed tabs 40, as shown at arrow 42 at FIG. 9, is less than the width of the graspable tab 34. Also, as is clearly seen in FIGS. 9 and 13, the first end 60 of the graspable tab 34 extends forwardly of the pair of opposed tabs 40.

Finally, in a particular embodiment of the second embodiment of the present invention, at least the portion of the substantially planar container thickness defining face 16 against which the graspable tab 34 is placed, is formed as a shallow groove 38. This is seen particularly FIG. 8. Of course, the width of the shallow groove 38 is greater than the width of the graspable tab 34.

There has been shown a structure for removably securing a container or other item which has width, depth, and thickness, to a substantially planar supporting surface. Several different retaining means have been shown whereby a graspable tab, which forms part of this structure, can be retained in a generally out of sight condition, but which is readily accessible, so as to be placed into an operable position if and when necessary.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element, without necessarily being restricted to that preciseness of meaning.

Moreover, word "generally" is intended to convey a sense of generality or a meaning of "more than less". Thus the phrase "generally out of sight" is meant to mean not entirely out of sight, discernable, but not prominent.

What is claimed is:

1. In combination, a container and a structure for removably securing said container to a substantially planar supporting surface in such a manner that a portion of the structure is retained in a position which is generally out of sight but from which said portion may be put into an operable position, wherein said container to be removably secured to a substantially planar supporting surface has width, depth, and thickness, and has a substantially planar back face which is to be placed adjacent the substantially planar supporting surface, and at least one substantially planar container thickness defining face which extends forwardly from said substantially planar back face, said structure comprising:

a flexible plastic tape having an adhesive coating on at least a first portion of each of the first and second sides thereof, and having a second portion at a first end of each of said first and second sides where there is no adhesive coating adhered thereto;

wherein said first side of said flexible plastic tape is adhered to the substantially planar back surface of said container at said first portion of said tape;

wherein said second portion of said flexible plastic tape forms a graspable tab to facilitate removal of said container from a planar supporting surface when adhered thereto by the adhesive coating on said second side of said tape, and wherein de-adherence of said flexible plastic tape at least from said planar supporting surface is achieved by stretching said tape by grasping said graspable tab; and wherein said structure further comprises retaining means for said graspable tab;

said retaining means being located on said at least one substantially planar container thickness defining face for releasably retaining said graspable tab in a folded and generally out of sight condition extending forwardly from said substantially planar back face.

2. The combination of claim 1, wherein said retaining means comprises a slot formed in said at least one substantially planar container thickness defining face for inserting said first end of said flexible plastic tape thereinto;

said slot being parallel to said substantially planar back face of said container, and located a distance away therefrom, which distance is less than the length of said graspable tab.

3. The combination of claim 1, wherein said retaining means comprises a pair of opposed tabs spaced away from and substantially parallel to that portion of said at least one substantially planar container thickness defining face against which said graspable tab is placed when it is folded forwardly from said substantially planar back face;

wherein the distance between said opposed tabs is less than the width of said graspable plastic tab; and wherein said first end of said graspable plastic tab extends forwardly of said pair of opposed tabs.

4. The combination of claim 3, wherein said portion of said at least one substantially planar container thickness defining face against which said graspable tab is placed, is formed as a shallow groove having a width greater than the width of said graspable plastic tab.

5. The combination of claim 1, wherein said container is rectangular having a front face opposed to said substantially planar back face, a top face, a bottom face, and a pair of opposed side faces, and said at least one substantially planar container thickness defining face is said bottom face thereof.

* * * * *